US007578903B2

(12) United States Patent
Uehara et al.

(10) Patent No.: US 7,578,903 B2
(45) Date of Patent: Aug. 25, 2009

(54) COLORED SANITARY TISSUE PAPER AND PRODUCTION METHOD THEREOF

(75) Inventors: Tetsuya Uehara, Fujinomiya (JP); Minoru Iwasaki, Fujinomiya (JP)

(73) Assignee: Daio Paper Corporation, Ehime (JP)

( * ) Notice: Subject to any disclaimer, the term of this patent is extended or adjusted under 35 U.S.C. 154(b) by 310 days.

(21) Appl. No.: 10/581,421

(22) PCT Filed: Dec. 2, 2004

(86) PCT No.: PCT/JP2004/017950

§ 371 (c)(1),
(2), (4) Date: Sep. 8, 2006

(87) PCT Pub. No.: WO2005/054577

PCT Pub. Date: Jun. 16, 2005

(65) Prior Publication Data

US 2007/0110963 A1 May 17, 2007

(30) Foreign Application Priority Data

Dec. 2, 2003 (JP) ..... 2003-403011

(51) Int. Cl.
*D21H 21/28* (2006.01)
*D21H 23/04* (2006.01)
*B31F 1/07* (2006.01)

(52) U.S. Cl. ..... 162/162; 162/109; 162/117; 162/158; 162/183; 428/156; 428/488.11; 8/554; 8/619

(58) Field of Classification Search ..... 162/109, 162/117, 158, 162, 164.1, 164.3, 164.6, 168.1, 162/168.3, 179, 183; 8/550, 551, 554, 619; 428/409, 488.11, 156, 153; 156/183, 209, 156/219
See application file for complete search history.

(56) References Cited

U.S. PATENT DOCUMENTS

| | | | | | |
|---|---|---|---|---|---|
| 1,732,540 | A * | 10/1929 | Sayler | 162/112 |
| 1,805,013 | A * | 5/1931 | Sayler | 162/112 |
| 1,863,813 | A * | 6/1932 | Alden et al. | 162/112 |
| 1,926,614 | A * | 9/1933 | Draves | 8/602 |
| 2,234,648 | A * | 3/1941 | Lubs et al. | 8/664 |
| 3,512,914 | A * | 5/1970 | Fleischer | 8/487 |
| 3,579,498 | A * | 5/1971 | Dunworth | 534/756 |
| 4,071,312 | A * | 1/1978 | Blackwell | 8/648 |
| 4,383,834 | A * | 5/1983 | Degen et al. | 8/551 |
| 5,209,953 | A * | 5/1993 | Grupe et al. | 427/276 |
| 5,223,096 | A * | 6/1993 | Phan et al. | 162/158 |
| 5,395,690 | A * | 3/1995 | Kawahata et al. | 428/355 N |
| 7,316,845 | B2 * | 1/2008 | Hubbell et al. | 428/426 |
| 2006/0168914 | A1 * | 8/2006 | Steeves-Kiss et al. | 53/443 |
| 2007/0110963 | A1 * | 5/2007 | Uehara et al. | 428/156 |

FOREIGN PATENT DOCUMENTS

| | | | |
|---|---|---|---|
| JP | 57-171797 | | 10/1982 |
| JP | 7-500641 | | 1/1995 |
| JP | 7-166079 | | 6/1995 |
| JP | 2003-500571 | | 1/2003 |
| JP | 2003-55897 | | 3/2003 |
| JP | 2003-310475 | | 11/2003 |
| JP | 2007135851 | A * | 6/2007 |
| JP | 2008057084 | A * | 3/2008 |
| WO | WO 0073585 | A1 * | 12/2000 |

* cited by examiner

*Primary Examiner*—José A Fortuna
(74) *Attorney, Agent, or Firm*—William L. Androlia; H. Henry Koda

(57) ABSTRACT

The invention is directed to obtain a colored sanitary tissue paper giving a bright feeling in spite of modest color. The invention provides a colored sanitary tissue paper with a color difference between before and after dyeing of 15 or more in D value of Hunter's color difference formula defined in JIS Z 8730; $D=(\Delta L^2+\Delta a^2+\Delta b^2)^{1/2}$.

7 Claims, 2 Drawing Sheets

COLORED SANITARY TISSUE PAPER AND PRODUCTION METHOD THEREOF

TECHNICAL FIELD

The present invention relates to a colored sanitary tissue paper such as toilet paper and tissue paper and a production method thereof, and particularly to a toilet paper roll.

BACKGROUND ART

In recent years, toilet paper rolls colored with dyes giving a fancy feeling, in addition to normal white rolls, have been available from several companies. The colors are light pink, blue, yellow and green.

However, pastel color tone is seemingly intended to give elegance, in fact, for example, in a rest room under incandescent light, it becomes dull color sense.

As far as the present inventors know, no proposal has been found for improving the point above mentioned.

Patent Reference 1: Japanese Unexamined Patent Publication 2003-55897

Patent Reference 1: Japanese Unexamined Patent Publication 2003-310475

DISCLOSURE OF THE INVENTION

Problems to be Solved by the Invention

Problems to be solved are the lack of means for giving a bright feeling in spite of modest color.

Means to Solve the Problems

SUMMARY OF THE INVENTION

A colored sanitary tissue paper comprising: a dye being added to a pulp raw material, wherein a color difference between before and after dyeing is 15 or more in D value of Hunter's color difference formula defined in JIS Z 8730; $D=(\Delta L^2+\Delta a^2+\Delta b^2)^{1/2}$.

A colored sanitary tissue paper comprising: a dye being added to a pulp raw material, wherein a color difference between before and after dyeing is 82.0% or more in L value and a range of 15 to 40 in D value of Hunter's color difference formula defined in JIS Z 8730; $D=(\Delta L^2+\Delta a^2+\Delta b^2)^{1/2}$.

The colored sanitary tissue paper further includes a softening agent and a paper strength agent as well as a dye which are added to the pulp raw material in the quantity per one ton of paper stuff, 0.1-15 kg/t of the softening agent, 0.1-25 kg/t of the paper strength agent and 0.05-15 kg/t of the dye.

The colored sanitary tissue paper may further include a pink color tone and L value of 82.0% or more, preferably 82.0-98.0%, a value of 12 or more, preferably 12-22, and b value of 5 or less, preferably −5 to 5.

The colored sanitary tissue paper may also include a blue color tone and L value of 82.0% or more, preferably 82.0-98.0%, a value of −5 or less, preferably −15 to −5, and b value of −5 or less, preferably −15 to −5.

The colored sanitary tissue paper may also include a yellow color tone and L value of 82.0% or more, preferably 82.0-98.0%, a value of 0 or less, preferably −13 to −3, and b value of 14 or more, preferably 24-34.

The colored sanitary tissue paper may also include a green color tone and L value of 82.0% or more, preferably 82.0-98.0%, a value of −6 or less, preferably −24 to −14, and b value of 8 or more, preferably 9-19.

The colored sanitary tissue paper is an embossed colored sanitary tissue paper with convex parts between embosses relatively formed by scattered embosses, wherein an embossing-pressure imparted area makes up 5 to 20% of the total.

The colored sanitary tissue paper includes waste paper pulp compounded in 0 to 50%.

A production method of colored sanitary tissue paper, comprising the steps of: firstly adding a cationic softening agent to a pulp raw material, then adding an anionic dye thereto, and obtaining a colored sanitary tissue, paper with a color difference between before and after dyeing being 15 or more in D value of Hunter's color difference formula defined in JIS Z 8730; $D=(\Delta L^2+\Delta a^2+\Delta b^2)^{1/2}$.

Effect of the Invention

When a dye is added to a pulp raw material, a color difference between before and after dyeing in D value of Hunter's color difference formula defined in JIS Z 8730; $D=(\Delta L^2+\Delta a^2+\Delta b^2)^{1/2}$ is 15 or more, particularly in a range of 15 to 40, a colored sanitary tissue paper with a rich brightness and clear impact without addition of fluorescence dye in spite of modesty color can be obtained. Additionally, it appears bright even in a rest room under incandescent light, permitting the space of rest room to give a bright feeling.

A softening agent and paper strength agent besides a dye are added according to need, from the reasons described bellow, it is preferable that per one ton of paper stuff, the softening agent of 0.1-15 kg/t, the paper strength agent of 0.1-25 kg/t and the dye of 0.05-15 kg/t are added.

When each color tone of pink, blue, yellow and green is given, it has been found that it is desirable to be in the range of respective values of L value, a value and b value specified above, regarding the effect of the present invention to be performed.

In the case that a toilet paper roll is an embossed colored sanitary tissue with convex parts between embosses relatively formed by scattered embosses, when an embossing-pressure imparted area is 5 to 20% of total area, in relation to the foregoing color characteristics, concave part and convex. part appear clearly, which enhances a product value.

The foregoing color characteristics are not practically damaged even when waste paper pulp is compounded into a pulp raw material in a range of 50% or less.

In the case of using softening agent and dye, it is desirable that a cationic softening agent is firstly added to a pulp raw material, afterwards an anionic dye is added thereto. Pulp is anionic. On the other hand, in the case of adding a cationic softening agent and an anionic dye, because the anionic dye combines cationic substances, through which combines pulp fiber, this fixates substances (dust, dirt etc.) other than a target substance, so that a paper tends to become hard. Therefore, a cationic softening agent (if necessary, cationic paper strength agent as well) is firstly added to combine pulp, by adding an anionic dye afterwards, a sanitary tissue paper with soft texture can be produced.

DETAILED DESCRIPTION OF THE INVENTION

By setting a color difference between before and after dyeing of 82.0% or more in L value and 15 or more, particularly a range of 15 to 40 in D value of Hunter's color difference formula defined in JIS Z 8730; $D=(\Delta L^2+\Delta a^2+\Delta b^2)^{1/2}$, a colored sanitary tissue paper giving a bright feeling in spite of modest color was obtained. When the color difference is less than 15, in the case of sale of colored sanitary tissue paper of the invention, it is not appealing to customers at stores, also in the case of colored sanitary tissue toilet paper of the invention, color is not outstanding in use in a dim toilet space. On the other hand, when the color difference is more than 40, color could be too outstanding and be irritating color tone.

As is known, it is expressed that L value is a lightness index, a value and b value are chromaticness indexes. ΔL represents a difference between $L_0$ value of before-dying and $L_1$ value of after-dyeing, Δa and Δb similarly represent the differences $\Delta a=a_0-a_1$, $\Delta b=b_0-b_1$, respectively. Thus, the present inventors have found from a lot of experiments and various evaluations that not only each of these values alone, but also the correlation thereof determines lightness and brightness.

Regarding D value, when D value is small, brightness lacks, when excessively large, elegance lacks. The present invention specifies the range of moderately brightness and not pale color.

In the specified range of D value, the following range is each preferable: when color tone is a pink system, L value of 82.0% or more, a value of 12 or more, and b value of 5 or less; when color tone is a blue system, L value of 82.0% or more, a value of −5 or less, and b value of −5 or less; when color tone is a yellow system, L value of 82.0% or more, a value of 0 or less, and b value of 14 or more; when color tone is a green system, L value of 82.0% or more, a value of −6 or less, and b value of 8 or more. Although reasons for the ranges are not definite, they are ascertained from a lot of experiments and monitoring evaluations. Upper limit of L value is not limited, and it is practical up to 98%.

On obtaining an embossed colored sanitary tissue paper with convex parts between embosses relatively formed by scattered embosses, it is desirable that an embossing-pressure imparted area is 5 to 20% of total area. When the embossing-pressure area is too small, brightness lacks due to flatness of paper, adversely, when too large, elegance lacks due to being visually rough. It seems to be quite a new finding that embossing and color tone have a correlation.

In the case of obtaining two ply double embossed toilet paper, it is desirable to form emboss such that a practically plane top face 1 is produced on one side, the area is 0.50 to 2.50 $mm^2$, the number is 5 to 30 per 10 mm square and the depth of concave part of emboss is 0.20 to 3.00 mm.

Imparted emboss pattern is not limited, but, it is desirable to have a cross sectional shape of Mt. Fuji shown in FIGS. 1 to 3. Namely, emboss part is formed so that the top face 1 is disposed in a diagonal lattice point to form an edge line 3.

In the present invention, waste paper pulp can be compounded into a pulp raw material in 50% or less, preferably 30% or less. When the composition ratio of waste paper pulp increases, lightness is lowered, color becomes dark and dull, thus the object of the present invention cannot be achieved. Optimally, it is desirable to use a virgin pulp of 100% without adding waste paper pulp in order to obtain brightness and lightness.

Accordingly, as a pulp raw material of the present invention, the example includes unbleached mechanical pulp, bleached mechanical pulp, chemical wood pulp, chemical non-wood pulp, disaggregated or deinked bleached waste paper pulp of magazine waste paper, newspaper waste paper, office related waste paper, communication waste paper, cardboard waste paper and paper container waste paper.

On the other hand, as described above, in the case of adding a cationic softening agent and an anionic dye, the cationic softening agent (if necessary, cationic paper strength agent as well) is firstly added to combine pulp, afterwards the anionic dye is added thereto, thereby to yield a sanitary tissue paper with soft texture. For example, in a pulp raw material, for example, in a machine tank, a pulp raw material and a cationic softening agent (if necessary, cationic paper strength agent as well) are compounded in a machine tank, a dye is compounded in the machine tank, a seeding box, or before a fan pump to color a paper.

As a softening agent, there listed are fatty acid ester based softening agents (U.S. Pat. No. 3,296,065 specification), quaternary ammonium salt type cationic softening agents (Japanese Unexamined Patent Publication Shou 48-22701 (1973)), urethane alcohol or the salt, or cationic compounds (Japanese Unexamined Patent Publication Shou 60-139897 (1985)), non-cationic type surfactants (Japanese Unexamined Patent Publication Hei 2-99690 (1990) and Hei 2-99691 (1990)), polyphosphoric acid salt (Japanese Unexamined Patent Publication Hei 2-36288 (1990)), polysiloxane (Japanese Unexamined Patent Publication Hei 2-224626 (1990) and Hei 3-900 (1990)). Particularly preferable softening agents are quaternary ammonium salt type softening agents and/or fatty acid ester based softening agents, both of which show cationic characteristics. As a dye, it includes an azo type dye, a dye fixer can be concomitantly used if necessary. As a paper strength agent (wet paper strength increasing agent), the example includes amino resins such as urea-formaldehyde resin and melamine-formaldehyde resin, polyamide epichlorohydrin based resin, and dialdehyde starch.

As composition amounts of softening agent, paper strength agent (wet paper strength increasing agent) and dye, they are per one ton of paper stuff, a softening agent of 0.1-15 kg/t (preferably 0.3-3.0 kg/t), a paper strength agent of 0.1-25 kg/t (preferably 1.0-5 kg/t), and a dye of 0.05-15 kg/t (preferably 0.1-2 kg/t), respectively. Regarding these materials, problems arise when beyond the respective upper limits as follows, softening agent: paper strength lowers too much, paper strength agent: paper becomes hard, dye: color is too deep (becomes dark), and problems arise when below the respective lower limits as follows, softening agent: no effect is obtained, paper strength agent: no effect is obtained, and dye: color is too pale (lacks brightness).

EXAMPLES

An example (Example) of product according to the present invention and a commercially available product were measured for each value in Hunter's color difference formula defined in JIS Z 8730. Additionally, because base papers of other companies are impossible to get, by employing the base paper being used by the patent applicant, the color difference between before and after dyeing was measured. This proves even a sufficient validity because there is no significant difference between before dyeing. The results are shown in Table 1.

TABLE 1

| | Pink | | | | Blue | | | |
|---|---|---|---|---|---|---|---|---|
| Sort | L value | a value | b value | D value | L value | a value | b value | D value |
| Base paper before dyeing | 96.4 | 0.0 | 2.7 | — | 96.4 | 0.0 | 2.7 | — |

TABLE 1-continued

| | | | | | | | | | | |
|---|---|---|---|---|---|---|---|---|---|---|
| Example | Example 1 | 85.9 | 17.1 | 0.3 | 20.2 | Example 2 | 85.6 | −9.5 | −10.3 | 19.3 |
| | Example 5 | 90.5 | 10 | 0.4 | 11.8 | Example 6 | 88.5 | −2.4 | −11.4 | 16.3 |
| | Example 9 | 87.5 | 24 | 2.4 | 25.6 | Example 10 | 90.8 | −16.5 | −12.5 | 23.1 |
| | Example 13 | 85.3 | 11.8 | 6.7 | 16.7 | Example 14 | 91.7 | −8.8 | −4.3 | 12.2 |
| | Example 17 | 83.3 | 20.7 | −7.8 | 26.7 | Example 18 | 83.7 | −9.8 | −16.4 | 24.9 |
| | Example 21 | 93.2 | 17.5 | 1.7 | 17.8 | | | | | |
| | Example 24 | 98.5 | 12.2 | 0.6 | 12.6 | | | | | |
| | Example 27 | 86.5 | 18.3 | 2.1 | 20.8 | | | | | |
| | Example 28 | 83.7 | 16.6 | 0.2 | 21.0 | | | | | |
| | Example 29 | 86.9 | 15.5 | 1.1 | 18.2 | | | | | |
| | Example 30 | 91.2 | 17.8 | 0 | 18.7 | | | | | |
| A company' product | Comparative example 1 | 89.8 | 9.8 | 4.7 | 12.0 | Comparative example 7 | 88.8 | −4.4 | −1.4 | 9.6 |
| | Comparative example 2 | 91.4 | 8.4 | 4.1 | 9.9 | Comparative example 8 | 91.4 | −4.3 | −4.4 | 9.6 |
| | Comparative example 3 | 90.4 | 8.9 | −0.1 | 11.1 | | | | | |
| | Comparative example 4 | 90.5 | 10.2 | 7.4 | 12.7 | | | | | |
| B company' product | Comparative example 5 | 90.2 | 11.6 | 3.2 | 13.2 | Comparative example 9 | 87.7 | −3.6 | −5.3 | 12.3 |
| C company' product | Comparative example 6 | 92.8 | 5.2 | 0.9 | 6.6 | | | | | |

| | Yellow | | | | | Green | | | | |
|---|---|---|---|---|---|---|---|---|---|---|
| | | L value | a value | b value | D value | | L value | a value | b value | D value |
| Base paper before dyeing | | 96.4 | 0.0 | 2.7 | — | | 96.4 | 0.0 | 2.7 | — |
| Example | Example 3 | 95.1 | −8.9 | 29.1 | 27.9 | Example 4 | 83.5 | −18.7 | 13.8 | 25.2 |
| | Example 7 | 83.9 | 0.4 | 25.2 | 25.7 | Example 8 | 87.6 | −5.7 | 12.3 | 14.2 |
| | Example 11 | 87.4 | −2.4 | 29.5 | 28.4 | Example 12 | 83.8 | −18.2 | 12.4 | 24.2 |
| | Example 15 | 84.7 | −14.7 | 27.1 | 30.8 | Example 16 | 82.8 | −26.2 | 13.3 | 31.4 |
| | Example 19 | 91.4 | −12.4 | 13.8 | 17.4 | Example 20 | 84.2 | −17.5 | 6.3 | 21.6 |
| | Example 22 | 85.2 | −7.5 | 18.4 | 20.7 | Example 23 | 92.4 | −19.8 | 8.7 | 21.1 |
| | Example 25 | 89.2 | −7.7 | 36.0 | 34.9 | Example 26 | 93.3 | −20.3 | 22.1 | 28.2 |
| A company' product | | | | | | Comparative example 11 | 89.6 | −5.0 | 3.0 | 8.4 |
| B company' product | | | | | | Comparative example 12 | 93.0 | −5.8 | 9.4 | 9.5 |
| C company' product | Comparative example 10 | 92.8 | 0.5 | 13.5 | 11.4 | | | | | |

Additionally, in all Examples, convex parts between embosses were relatively formed by scattered embosses. In particular, in Examples 1 to 26, the emboss such that a practically plane top face was produced on one side, the area of the top surface was 0.50 to 2.50 $mm^2$ and the depth of concave part of emboss was 0.20 to 3.00 mm was formed in the number of 5 to 30 per 10 mm square so that an embossing-pressure imparted area was 5 to 20% of total area. In addition, emboss was formed in an arbitrary number so that the embossing-pressure imparted area was 3% of total area in Example 27 and embossing-pressure imparted area was 25% of total area in Example 28.

Further, in Examples 1 to 28, a cationic softening agent was firstly added, afterwards an anionic dye was added, in Example 29, a cationic softening agent and an anionic dye were added at the same time, in Example 30, an anionic dye was firstly added, afterwards a cationic softening agent was added. Additionally, in Examples, the same sorts of waste paper, softening agent and paper strength agent were used in all examples, and as a dye, the same dye for each color was commonly used. Table 2 shows the composition of respective Examples (composition ratio of waste paper, use-amount of softening agent, use-amount of paper strength agent, use-amount of dye).

TABLE 2

| | Pink | | | | | Blue | | | | |
|---|---|---|---|---|---|---|---|---|---|---|
| | Sort | Waste paper composition ratio (%) | Softening agent (kg/t) | Paper strength agent (kg/t) | Dye (kg/t) | | Waste paper composition ratio (%) | Softening agent (kg/t) | Paper strength agent (kg/t) | Dye (kg/t) |
| Example | Example 1 | 0 | 1.0 | 0 | 1.5 | Example 2 | 0 | 1.5 | 1.0 | 1.8 |
| | Example 5 | 0 | 3.0 | 1.0 | 2.0 | Example 6 | 5 | 2.5 | 0.5 | 2.5 |
| | Example 9 | 0 | 1.0 | 0.2 | 4.0 | Example 10 | 0 | 4.0 | 2.0 | 3.5 |
| | Example 13 | 10 | 1.5 | 0 | 1.2 | Example 14 | 0 | 4.5 | 3.0 | 0.5 |
| | Example 17 | 20 | 2.5 | 2.5 | 3.5 | Example 18 | 20 | 5.5 | 5.5 | 3.8 |
| | Example 21 | 0 | 0.5 | 0 | 2.5 | | | | | |

TABLE 2-continued

| | | | | | |
|---|---|---|---|---|---|
| | Example 24 | 0 | 2.5 | 1.0 | 1.0 |
| | Example 27 | 0 | 3.0 | 4.0 | 1.0 |
| | Example 28 | 30 | 6.0 | 8.0 | 0.7 |
| | Example 29 | 0 | 1.0 | 7.5 | 1.3 |
| | Example 30 | 0 | 0.5 | 0.5 | 2.5 |

| | Yellow | | | | | Green | | | | |
|---|---|---|---|---|---|---|---|---|---|---|
| | | Waste paper composition ratio (%) | Softening agent (kg/t) | Paper strength agent (kg/t) | Dye (kg/t) | | Waste paper composition ratio (%) | Softening agent (kg/t) | Paper strength agent (kg/t) | Dye (kg/t) |
| Example | Example 3 | 0 | 1.5 | 0.5 | 2.0 | Example 4 | 0 | 1.0 | 1.5 | 2.5 |
| | Example 7 | 25 | 2.5 | 2.0 | 3.2 | Example 8 | 0 | 1.5 | 0 | 1.3 |
| | Example 11 | 0 | 3.0 | 3.0 | 1.5 | Example 12 | 15 | 2.5 | 2.5 | 2.5 |
| | Example 15 | 35 | 6.5 | 9.0 | 1.5 | Example 16 | 40 | 3.0 | 1.0 | 1.5 |
| | Example 19 | 0 | 1.0 | 0.5 | 1.0 | Example 20 | 0 | 1.0 | 0.7 | 1.0 |
| | Example 22 | 0 | 0.5 | 1.0 | 0.8 | Example 23 | 0 | 1.5 | 1.0 | 3.5 |
| | Example 25 | 0 | 0 | 0 | 4.5 | Example 26 | 0 | 2.0 | 2.5 | 1.2 |

Fifty monitors who were distributed over age layers were asked to evaluate each of commercial products and products of Examples. The results, except one monitor, showed that all products of Examples gave a feeling of brightness in spite of modesty color in comparison with the commercial products.

Similarly, fifty monitors who were distributed over age layers were asked to evaluate the visual clearness of emboss. As a result, except 12 monitors, it was evaluated that the products of Examples, in particular, the products of Examples 1-4 gave a clear feeling visually between the concave part and convex part of emboss in comparison with the commercial products.

Further, similarly, fifty monitors who were distributed over age layers were asked to evaluate the softness in texture of Example 1, Example 29 and Example 30. As a result, all monitors evaluated that the product of Example 1 gave them soft texture in comparison with the products of Examples 29 and 30.

Additionally, besides the products shown in Table 1, other examples were produced and evaluated, as a result, it was observed that the products within the foregoing specified range were excellent.

INDUSTRIAL APPLICABILITY

Toilet paper roll was described so far, it is apparent that the prevention includes tissue paper. In addition, the invention can apply sanitary papers with 1 ply, 2 plies, 3 or more plies.

DESCRIPTION OF NUMBER AND SYMBOL

Figure 1:
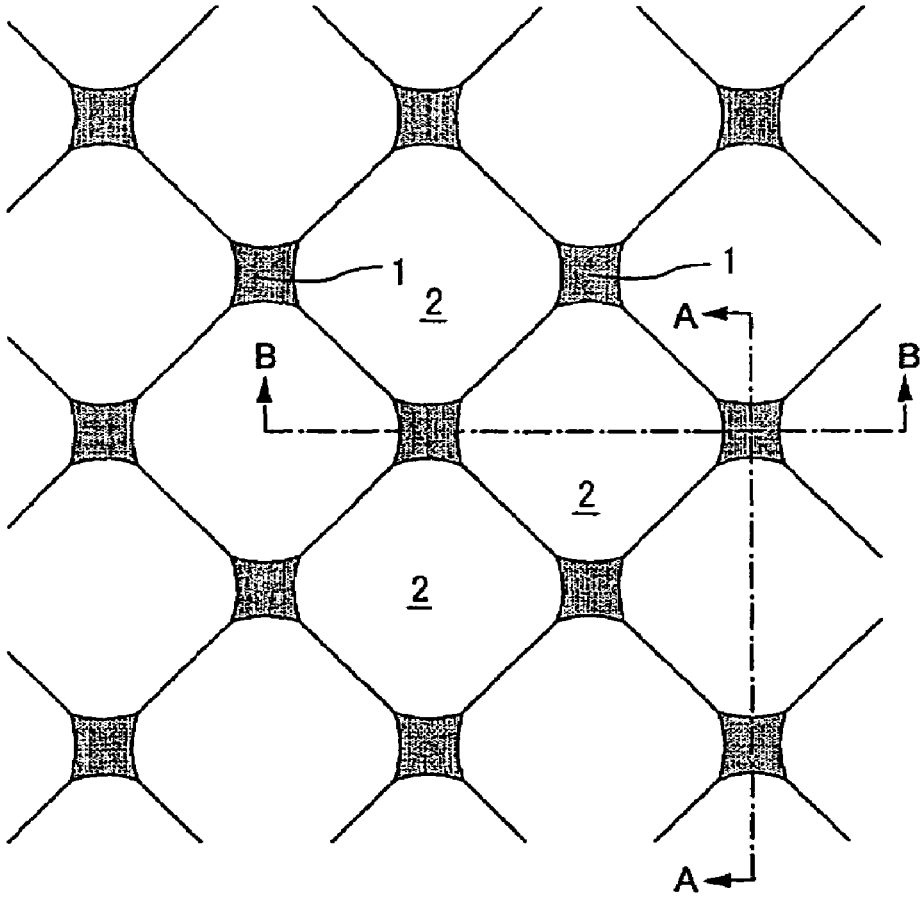
FIG. 1 is a plain view of embossed example of toilet roll.
Figure 2:
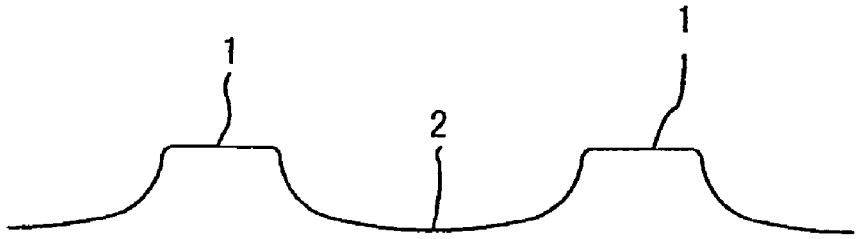
FIG. 2 is a cross sectional view along arrow A-A line and B-B line
Figure 3:
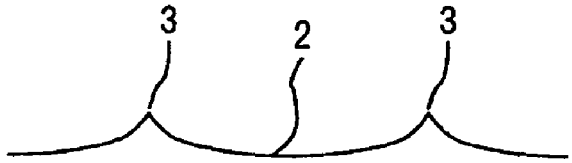
FIG. 3 is a cross sectional view along arrow C-C line.

1 . . . Top face, 2 . . . Concave part, 3 . . . Edge line

What is claimed is:

1. A colored sanitary tissue paper comprising: a dye being added to a pulp raw material, wherein:

a color difference between before and after dyeing is 15 to 40 in D value of Hunter's color difference formula defined in JIS Z 8730; $D=(\Delta L^2+\Delta a^2+\Delta b^2)^{1/2}$ and 82% or more in L value;

a softening agent and a paper strength agent as well as a dye are added to the pulp raw material in the quantity per one ton of paper stuff, 0.1-15 kg/t of the softening agent, 0.1-25 kg/t of the paper strength agent and 0.05-15 kg/t of the dye;

the colored sanitary tissue paper is an embossed colored sanitary tissue paper with convex parts between embosses relatively formed by scattered embosses;

an embossing-pressure imparted area makes up 5 to 20% of the total area; and a and b are area chromaticness indexes and L is a lightness index.

2. The colored sanitary tissue paper according to claim 1, comprising a pink color tone and an a value of 12 or more, and a b value of 5 or less.

3. The colored sanitary tissue paper according to claim 1 or 2, comprising a blue color tone and an a value of −5 or less, and a b value of −5 or less.

4. The colored sanitary tissue paper according to claim 1 or 2, comprising a yellow color tone and an a value of 0 or less, and a b value of 14 or more.

5. The colored sanitary tissue paper according to claim 1 or 2, comprising a green color tone and an a value of −6 or less, and a b value of 8 or more.

6. The colored sanitary tissue paper according to claim 1 or 2, wherein the pulp raw material is waste paper pulp and is compounded in 0 to 50%.

7. A production method of colored sanitary tissue paper, comprising the steps of: adding a cationic softening agent to a pulp raw material, then adding an anionic dye thereto, embossing said colored sanitary tissue paper with convex parts between embosses relatively formed by scattered embosses and obtaining said colored sanitary tissue paper with a color difference between before and after dyeing being 15 or more in D value of Hunter's color difference formula defined in JIS Z 8730; $D=(\Delta L^2+\Delta a^2+\Delta b^2)^{1/2}$ and wherein a and b are chromaticness indexes and L is a lightness index and an embossing-pressure imparted area makes up 5 to 20% of the total area.

* * * * *